US009498103B2

(12) United States Patent
Wang et al.

(10) Patent No.: US 9,498,103 B2
(45) Date of Patent: Nov. 22, 2016

(54) DETERGENT RELEASE CONTROLLER

(71) Applicant: Hangzhou Kambayashi Electronic Co., ltd, Hangzhou (CN)

(72) Inventors: Hua Wang, Hangzhou (CN); Pengfei Bao, Hangzhou (CN)

(73) Assignee: Hangzhou Kambayashi Electronic Co., ltd, Hangzhou, Zhejiang Province (CN)

( * ) Notice: Subject to any disclaimer, the term of this patent is extended or adjusted under 35 U.S.C. 154(b) by 127 days.

(21) Appl. No.: 14/431,711

(22) PCT Filed: Jul. 9, 2014

(86) PCT No.: PCT/CN2014/081862

§ 371 (c)(1),
(2) Date: Mar. 26, 2015

(87) PCT Pub. No.: WO2015/021835

PCT Pub. Date: Feb. 19, 2015

(65) Prior Publication Data

US 2015/0238066 A1 Aug. 27, 2015

(30) Foreign Application Priority Data

Aug. 16, 2013 (CN) ..... 2013 1 0358805

(51) Int. Cl.
*F17D 1/00* (2006.01)
*A47L 15/44* (2006.01)
(Continued)

(52) U.S. Cl.
CPC ..... *A47L 15/44* (2013.01); *A47L 15/4217* (2013.01); *A47L 15/4427* (2013.01); *D06F 39/02* (2013.01); *A47L 2501/01* (2013.01); *A47L 2501/07* (2013.01); *Y10T 137/2599* (2015.04); *Y10T 137/87265* (2015.04); *Y10T 137/87338* (2015.04); *Y10T 137/87354* (2015.04)

(58) Field of Classification Search
CPC ..... Y10T 137/2599; Y10T 137/87354; Y10T 137/87265; Y10T 137/87338; A47L 15/44; A47L 201/01; A47L 2501/07; A47L 15/4217; A47L 15/4427; D06F 39/02
See application file for complete search history.

(56) References Cited

U.S. PATENT DOCUMENTS 3,696,970 A * 10/1972 Bunnell ..... D06F 39/02 222/132
5,282,901 A * 2/1994 Reinhard ..... A47L 15/0055 134/18

(Continued)

FOREIGN PATENT DOCUMENTS

GB 608210 A * 9/1948 ..... A47L 15/4427
GB 1168466 A * 10/1969 ..... A47L 15/44
IT EP 2902540 A1 * 8/2015 ..... D06F 39/085

*Primary Examiner* — Jessica Cahill
(74) *Attorney, Agent, or Firm* — Tian IP & Technology, LLC.

(57) ABSTRACT

A simply structured and conveniently used detergent release controller capable of avoiding detergent from solidifying and preventing use has a main channel. One terminal of the main channel is an inlet of a fluid, and the other terminal of the main channel is an outlet capable of being connected with a water outlet of a washing barrel. The detergent release controller is provided with multiple valves including valve A, valve B, valve C, valve D, a liquid collecting cavity, and a Venturi negative pressure generator. An inlet of valve A is connected with a bypass of the main channel. An inlet of valve B is connected with a storage tank of detergent A. The present disclosure is applicable to apparatuses such as clothes washing machines and dish washing machines.

7 Claims, 8 Drawing Sheets

(51) Int. Cl.
*D06F 39/02* (2006.01)
*A47L 15/42* (2006.01)

(56) References Cited

U.S. PATENT DOCUMENTS 5,435,157 A * 7/1995 Laughlin ..... D06F 39/022 137/889
7,481,081 B2 * 1/2009 Hsu ..... D06F 33/02 68/17 R
9,340,918 B2 * 5/2016 Lv ..... D06F 39/022
2009/0095027 A1 * 4/2009 Deppermann ..... D06F 35/00 68/12.02
2010/0006593 A1 * 1/2010 Hellweg ..... A47L 15/0055 222/1
2010/0101030 A1 * 4/2010 Kim ..... D06F 33/02 8/159
2011/0154865 A1 * 6/2011 Lee ..... D06F 39/088 68/200
2014/0102543 A1 * 4/2014 Grant ..... B01F 5/043 137/3

* cited by examiner

A-A

DETERGENT RELEASE CONTROLLER

CROSS REFERENCE TO RELATED APPLICATION

This application is a national stage application of International application number PCT/CN2014/081862, filed Jul. 9, 2014, titled "Detergent Release Controller," which claims the priority benefit of Chinese Patent Application No. 201310358805.9, filed on Aug. 16, 2013, which is hereby incorporated by reference in its entirety.

TECHNICAL FIELD

The present disclosure relates to dispersing devices of liquid preparations, in particular to a liquid detergent release controller equipped on electric washing machines such as clothes washing machines and dish washing machines.

BACKGROUND

Previously, according to a method for adding liquid detergent (or softening agent, sanitizer, etc.) into electric washing devices such as clothes washing machine and dish washing machines, which use liquid detergent, users store the liquid detergent to be put into a designated container and washing devices put the detergent into barrels in a flushing or other mechanical ways by the washing process. In this way, the volume of the detergent released is determined by the operation of the users randomly, and the detergent needs releasing into the container each time when washing proceeds. As the detergent is continuously liquidized, storage of much detergent in a washing device is an application trend. In this way, the user can put into a certain amount of detergent upon demands in the washing process, thus simplifying the operation of the user and also performing automatic adjustment to the volume of the detergent released according to the category and quantity of the washed substances. Therefore, configuring an automatic detergent release on the washing machine is a development direction.

According to the prior art, there are following examples. In Japanese Patent Laid-Open 61-172594, for liquid detergent filled in a container, a certain pressure is released through an air pump to control the opening time of valve, thus controlling the volume of the detergent released. In Japanese Patent Laid-Open 2000-334197, an air pressure is completely released to the liquid detergent in the container to push the detergent out of the container. Those solutions need the user to completely seal the tank cover after the liquid detergent tank is fully filled within the detergent. If the sealing is poor, the pressure of the pump will leak. Even if the pressure of the pump is the same, the liquid detergent with different viscosity flows at a speed rate under the same pressure, thus causing inaccurate volume. In addition, the noises of the pump also affect the noise indicator control of the washing devices.

According to a technical solution disclosed on the Chinese market, a liquid detergent tank is disposed at the bottom of a washing device, through the pressure generated by a gear pump, and the liquid detergent is pressed to or attracted to a water box on the top of the washing device and then delivered into the barrel. In this solution, the gear pump is usually submerged in the detergent. When the detergent is exhausted, the residual detergent in the pump gets dry and solidified. During re-use, a big damping force will be generated to block the gear in the gear pump from rotating. And, the working noises of the gear pump do not affect the control over the noises indicators of the washing device. Moreover, this solution also has the problem that the difference in application speed caused by the fluctuation of the detergent viscosity causes application error.

In conclusion, if all the above-disclosed technologies employ the air pump to provide power, the problem of inaccurate volume of the detergent released due to the leakage from seal of the detergent tank cover and changes in the viscosity of the liquid detergent will be generated. When the contact mode similar to the gear pump is employed to provide the detergent with flowing force, the problem that the solidification of the liquid detergent causes blockage of the pump.

A Japanese Patent Laid-Open 11-019391 provides a solution, in which a water pump is disposed in the clothes washing machine; the water pump absorbs the water in the barrel of the washing machine and the water in the bathing pool; the water flows through a nozzle disposed on the pipe in the barrel; the nozzle has a negative pressure generator; when the pump delivers the water, the detergent is absorbed into the main water flow by means of the negative pressure generated by the nozzle, mixed and then put into the barrel. The power generated by means of this technology avoids the sealing problem of the power solution of the air pump and the solidification problem of the residual detergent of the gear pump solution, but the premise of this solution is to provide a water pump that provides a constant pressure. In this way, the cost is very high.

CN201258409Y discloses a device for generating the negative pressure in virtue of the water flow, but the negative pressure is generated by the tap water flow, but the force of the negative pressure is greatly related to the tap water pressure and the flow, so when the incoming water of the electromagnetic valve in the washing device is directly used to generate the negative pressure, the negative pressure will fluctuate in a large scope, and it is difficult to control the accuracy of the volume of the detergent.

Embodiment 2 of CN201258409Y puts forward that a metering box is disposed between the negative pressure device and the detergent box. Close valve 1-1 and valve 1-2, open valve 1-3 and valve 1-4, and then the metering box generates vacuum inside. Next, close valve 1-3 and valve 1-4, open valve 1-2, and then the liquid detergent flows into the metering box by means of the residual vacuum in the metering space. Then, close valve 1-1 and open valves 1-2, 1-3 and 1-4, the detergent in the metering box is absorbed into the water box through the negative pressure generated by the water flow.

CN201258409Y put forwards the method for solving the problem of volume error of the detergent resulted from the fluctuation of the negative pressure caused by the water flow in embodiment 1. However, in this solution, the metering box filled with the detergent absorbs the detergent through the negative pressure resided in the metering box on condition that the negative pressure source is cut from the metering box space. When the negative pressure is insufficient, the metering space cannot be fully filled, thus resulting in low accuracy of detergent volume. Actually, when the metering box and the negative pressure source are connected, the metering box never reaches the so-called vacuum. Let alone that when the metering box is cut from the vacuum source, the metering box has a certain negative pressure, but still has a certain air pressure (a certain amount of air exists), and as the metering box is filled with the liquid detergent, the residual space of the metering box gets small while the certain amount of air is compressed; then, the negative pressure in the residual space of the metering box disappears, and in such circumstances, the metering box cannot be filled with the detergent any more. With poor sealing of the metering box, this is a big problem. In addition, the detergent filled in the metering box is absorbed into the main water flow in virtue of the negative pressure. The detergent resides from the valve to the pipe. The concentrated or solidified detergent will block the flow of the detergent, and finally may affect the release effect.

SUMMARY

The present disclosure solves problems of complicated structure and inaccurate release of the liquid detergent release currently equipped on the washing devices and the problem that the residual and solidified detergent is easy to block the operation of the devices. Therefore, the present disclosure provides a detergent release controller. The detergent release controller has a simple structure, a small size and a high release accuracy, and is convenient to install and use and prevents detergent from attaching to the device.

To solve the above-mentioned problems, the present disclosure adopts the following technical solutions.

A detergent release controller has a main channel; one terminal of the main channel being an inlet of a fluid, and the other terminal of the main channel being an outlet capable of being connected with a water outlet of a washing barrel. In some implementations, the detergent release controller is provided with valve A, valve B, valve C, valve D, a liquid collecting cavity and a Venturi negative pressure generator. An inlet of valve A is connected with a bypass of the main channel. An inlet of valve B is connected with a storage tank of detergent A. Outlets of valve A and valve B are connected with an inlet of valve C. An inlet of valve D is capable of being connected with a storage tank of detergent B. Outlets of valve C and valve D are connected with an inlet of the liquid collecting cavity. An outlet of the liquid collecting cavity is connected with a negative pressure opening of the Venturi negative pressure generator via a back-flow channel. An outlet of the Venturi negative pressure generator is connected with an inlet of the main channel; and an inlet of the Venturi negative pressure generator is connected with a water source.

In some implementations, the back-flow channel is connected with a flow sensor.

In some implementations, the detergent release controller may include a pile-up valve. In some implementations, valve A, valve B, valve C, valve D, liquid collecting cavity and a back-flow channel are integrated in the pile-up valve; the pile-up valve is provided with an electromagnetic valve component I and an electromagnetic component II; the electromagnetic valve component I has an electromagnetic coil I; an inner sleeve of the electromagnetic valve component I has a piston I; the front end of the piston I is connected with a piston cap I; the electromagnetic valve component II has an electromagnetic coil II; an inner sleeve of the electromagnetic coil II is provided with a piston II; the front end of the piston II is provided with a piston cap II.

In some implementations, valve A and valve B correspond to the electromagnetic valve component I one-by-one; the outlet of valve A and the outlet of valve B run through an inner cavity I of the pile-up valve and are coaxially disposed at an interval in an opposite way in the inner cavity; the piston cap I of the electromagnetic valve component I is disposed within the interval between the outlet of valve A and the outlet of valve B. In normal state, the piston cap I closes the outlet of valve B and opens the outlet of valve A.

In some implementations, valve C and valve D correspond to the electromagnetic valve component II one-by-one; the outlet of valve C and the outlet of valve D run through an inner cavity II of the pile-up valve and are coaxially disposed at an interval in an opposite way in the inner cavity; the piston cap II of the electromagnetic valve component II is disposed within the interval between the outlet of valve C and the outlet of valve D. In normal state, the piston cap II closes the outlet of valve D and opens the outlet of valve C; and the inner cavity II runs through the inlet of the liquid collecting cavity.

The Venturi negative pressure generator and the main channel can be combined in the pile-up valve.

The outlets of valve A and valve B are connected with the inlet of the valve C; so the inner cavity I and the inner cavity II run through each other. In the present disclosure, the detergent refers to liquid detergent. The detergent A refers to a kind of detergent, and detergent B refers to another kind of detergent; in the present disclosure, valve B is used to release the detergent A, and valve D is used to release the detergent B. According to the present disclosure, the detergent A and the detergent B can be dispensed at the same time, or either detergent A or detergent B is disposed.

The Venturi generative pressure generator is made of a Venturi pipe; the reducing segment, namely the throat segment, of the Venturi pipe is used as the negative pressure opening. Through the Venturi effect, when the fluid flows inside from the inlet and outside from the outlet, a negative pressure is generated at the negative pressure opening, and thus a traction force toward the outside materials is generated.

What is related to the operation sequence of the present disclosure is that, in the water input process, valve A and valve C may be opened first, valve B and valve D are closed. Then a small branch of the water flow goes into the liquid collecting cavity through valve A, passes through the back-flow channel and the negative pressure opening of the negative pressure to be mixed with the inflow water, and then together with the inflow water is delivered to the washing barrel. This water flow effect of this branch loop is to flush the liquid collecting cavity and the related flow path, preventing the solidified residue of the detergent from affecting the use of the present disclosure. After the flushing is finished, closes the valve A and open the valve B and/or valve D. Then, the flushing water of the storage tank of the detergent A and/or detergent B enters the liquid collecting cavity through valve B, valve C and/or valve D to be mixed with the previously input flushing water and next mixed with the inflow water, and the mixed water flows into the washing barrel, realizing release of the detergent A and/or detergent B.

Implementations of the present disclosure may include a valve and a Venturi negative pressure generator, simply structured. The inlet of the negative pressure generator is connected with the water source, and the outlet of the negative pressure generator is connected with the main channel, so the present disclosure can be directly connected in series with the inlet pipe in use, simple to install and small in size. A small branch of the water flow in the main channel passes through valve A, valve B, liquid collecting cavity and back-flow channel in turn and together with the inflow water flows into the washing barrel to flush the liquid collecting cavity and the related flow paths, thus avoiding the solidified detergent residue affects use of the present disclosure. The present disclosure provided with the flow sensor can more accurately measure the released volume of the detergent.

The present disclosure provided with the pile-up valve has a compact structure, a small size and is low in cost, and convenient to install and use.

The two-piece-connected (two-piece-per-group) structure of the above mentioned detergent release controller include a group of valve A and valve B and a group of valve C and valve D. Based on the same principle, the present disclosure may be a three-piece-connected structure, which means that a group of valve E and valve F is added on the basis of the two-piece-connected structure.

In some implementations, a detergent release controller has a main channel, one terminal of the main channel being an inlet of a fluid, and the other terminal of the main channel being an outlet capable of being connected with a water inlet of a washing barrel, characterized in that valve A, valve B, valve C, valve D, valve E, valve F, a liquid collecting cavity and a Venturi negative pressure generator are provided; an inlet of valve A is connected with a bypass of the main channel; an inlet of valve B is capable of being connected with a storage tank of detergent A; outlets of valve A and valve B are connected with an inlet of valve C; an inlet of valve D is capable of being connected with a storage tank of detergent B; outlets of valve C and valve D are connected with an inlet of valve E; an inlet of valve F is connected with a storage tank of detergent C; outlets of valve E and valve F are connected with an inlet of the liquid collecting cavity; an outlet of the liquid collecting cavity is connected with a negative pressure opening of the Venturi negative pressure generator via a back-flow channel; an outlet of the Venturi negative pressure generator is connected with an inlet of the main channel; and an inlet of the Venturi negative pressure generator is connected with a water source.

In some implementations, the back-flow channel is connected with a flow sensor.

The detergent release controller may include a pile-up valve. In some implementations, Valve A, valve B, valve C, valve D, valve E, valve F, a liquid collecting cavity and a back-flow channel are integrated in the pile-up valve. The pile-up valve is provided with an electromagnetic valve component I, an electromagnetic valve component II and an electromagnetic component III. The electromagnetic valve component I has an electromagnetic coil I. An inner sleeve of the electromagnetic valve component I has a piston I. The front end of the piston I is connected with a piston cap I. The electromagnetic valve component II has an electromagnetic coil II. An inner sleeve of the electromagnetic coil II is provided with a piston II. An inner guide sleeve of the electromagnetic coil III is provided with a piston III. The front end of the piston III is provided with a piston cap III.

Valve A and valve B correspond to the electromagnetic valve component I one-by-one. The outlet of valve A and the outlet of valve B run through an inner cavity I of the pile-up valve and are coaxially disposed at an interval in an opposite way in the inner cavity. The piston cap I of the electromagnetic valve component I is disposed within the interval between the outlet of valve A and the outlet of valve B. In normal state, the piston cap I closes the outlet of valve B and opens the outlet of valve A. In normal state, the electromagnetic coil I is not electrified.

Valve C and valve D correspond to the electromagnetic valve component II one-by-one. The outlet of valve C and the outlet of valve D run through an inner cavity II of the pile-up valve and are coaxially disposed at an interval in an opposite way in the inner cavity. The piston cap II of the electromagnetic valve component II is disposed within the interval between the outlet of valve C and the outlet of valve D, and in normal state, the piston cap II closes the outlet of valve D and opens the outlet of valve C. In normal state, the electromagnetic coil II is not electrified.

Valve E and valve F correspond to the electromagnetic valve component III one-by-one. The outlet of valve E and the outlet of valve F run through an inner cavity III of the pile-up valve and are coaxially disposed at an interval in an opposite way in the inner cavity III. The piston cap III of the electromagnetic valve component III is disposed within the interval between the outlet of valve E and the outlet of valve F. In normal state, the piston cap III closes the outlet of valve E and opens the outlet of valve F. In normal state, the electromagnetic coil III is not electrified. The inner cavity III runs through the inlet of the liquid collecting cavity.

The Venturi negative pressure generator and the main channel can be combined in the pile-up valve.

The outlets of valve A and valve B are connected with the inlet of valve C, while the outlets of valve C and valve D are connected with the inlet of valve E, so the inner cavity I and the inner cavity II run through each other, and the inner cavity II and the inner cavity III run through each other.

The flow sensor is used to accurately measure the dispersed volume of the detergent.

Compared with the two-piece-connected structure, the three-piece-connected structure of the present disclosure has a wider application scope.

Based on the same principle, the present disclosure may be multi-piece-connected structure. For example, four-piece-connected structure is formed by adding valve G and valve H on the three-piece-connected structure. In this structure, the outlets of valve E and valve F are connected with the inlet of valve G; the outlets of valve G and valve H are connected with the inlet of the liquid collecting cavity; and the inlet of valve H is connected with the storage tank of detergent D.

Figure 1:
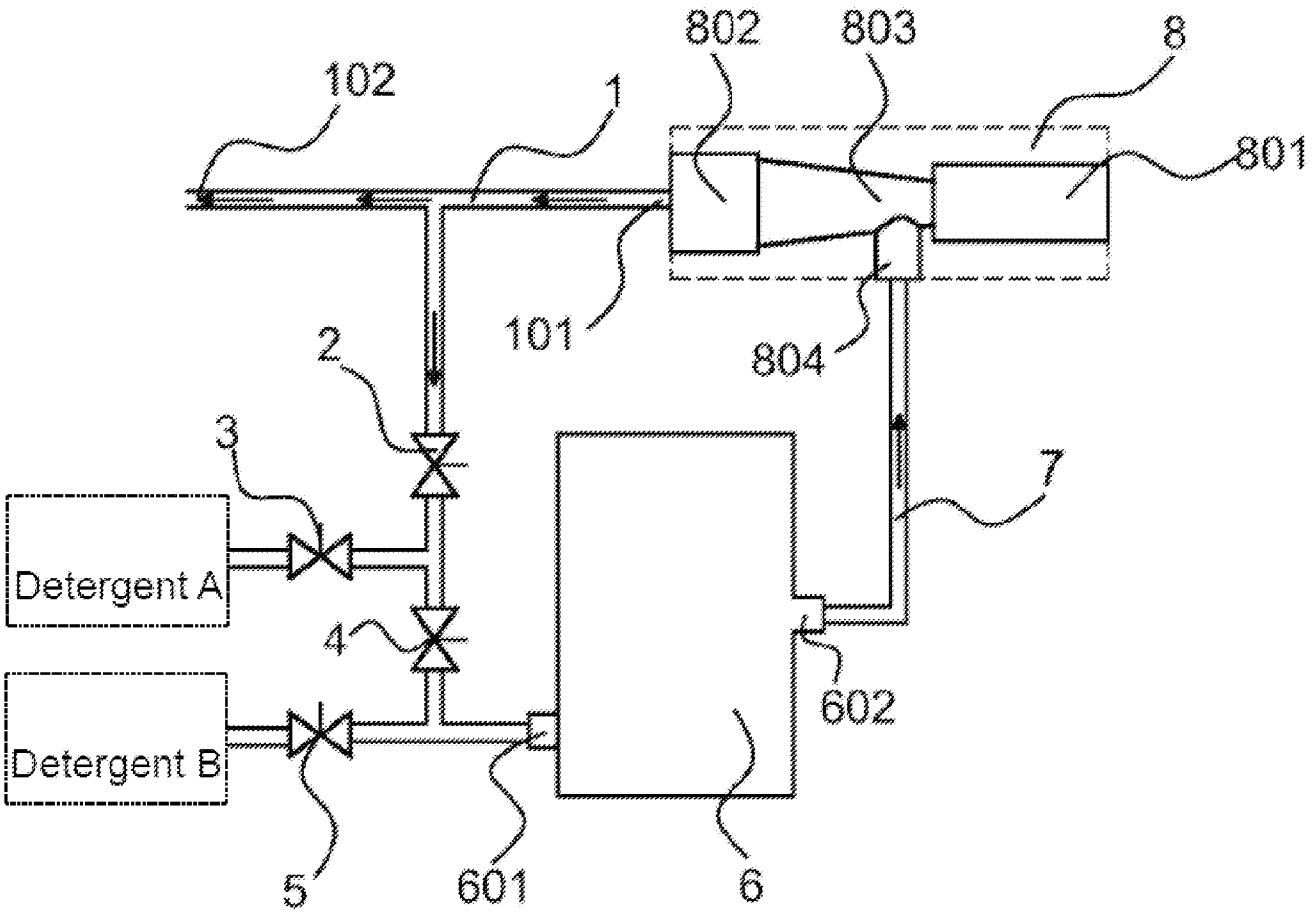
FIG. 1 is a schematic diagram illustrating a two-piece-connected structure of the present disclosure.
Figure 2:
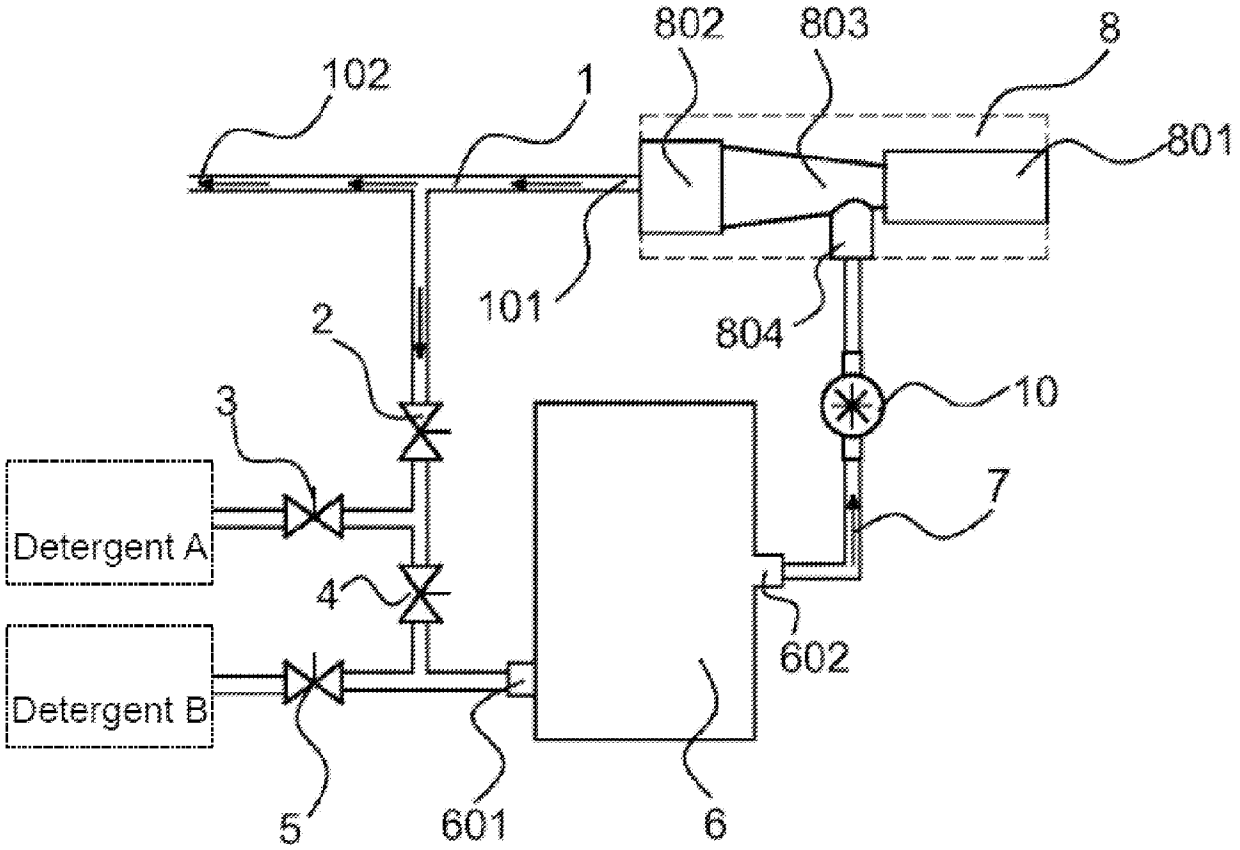
FIG. 2 is a schematic diagram illustrating a two-piece-connected structure of the present disclosure with a flow sensor.
Figure 3:
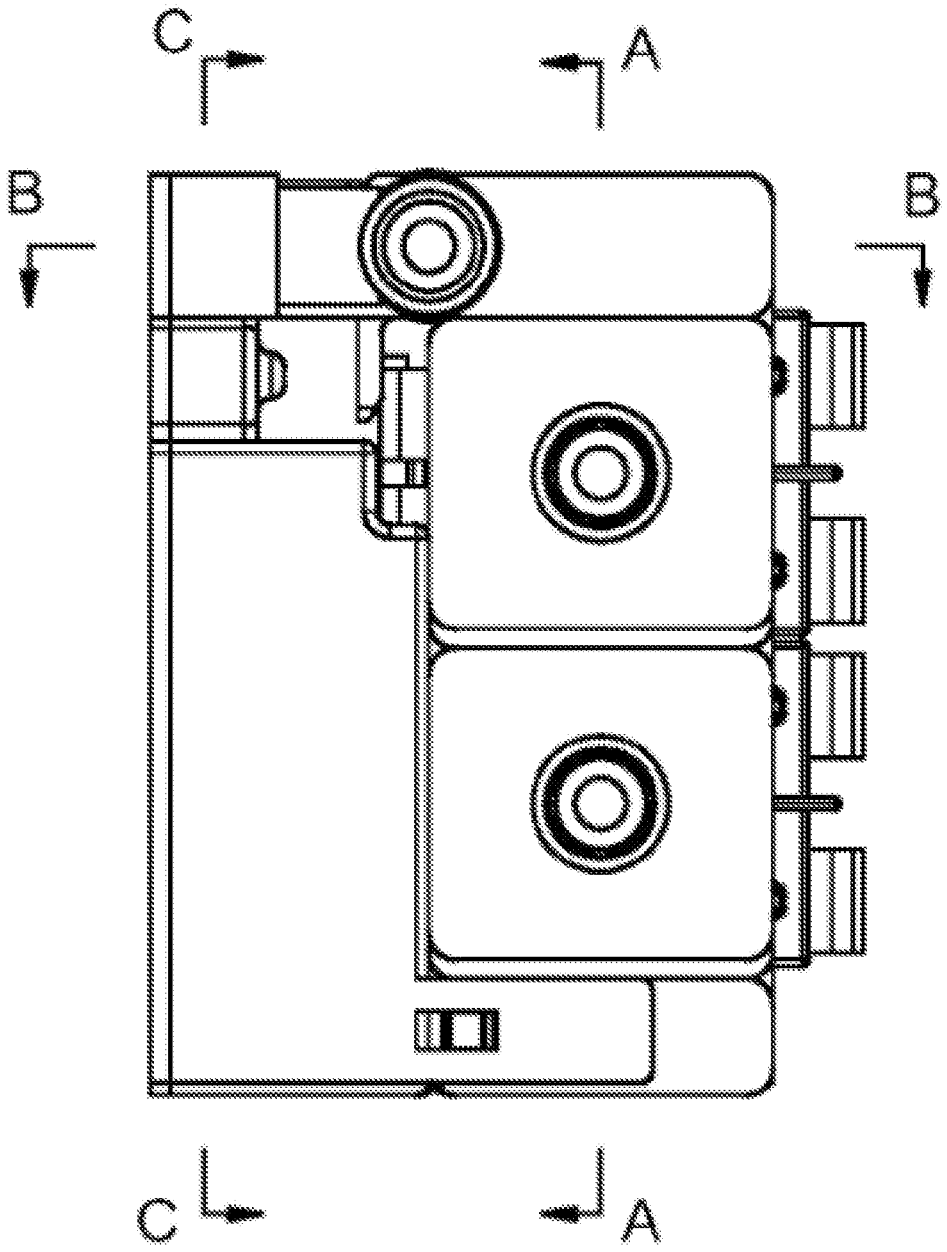
FIG. 3 is a profile view of a two-piece-connected structure of the present disclosure with a pile-up valve.
Figure 4:
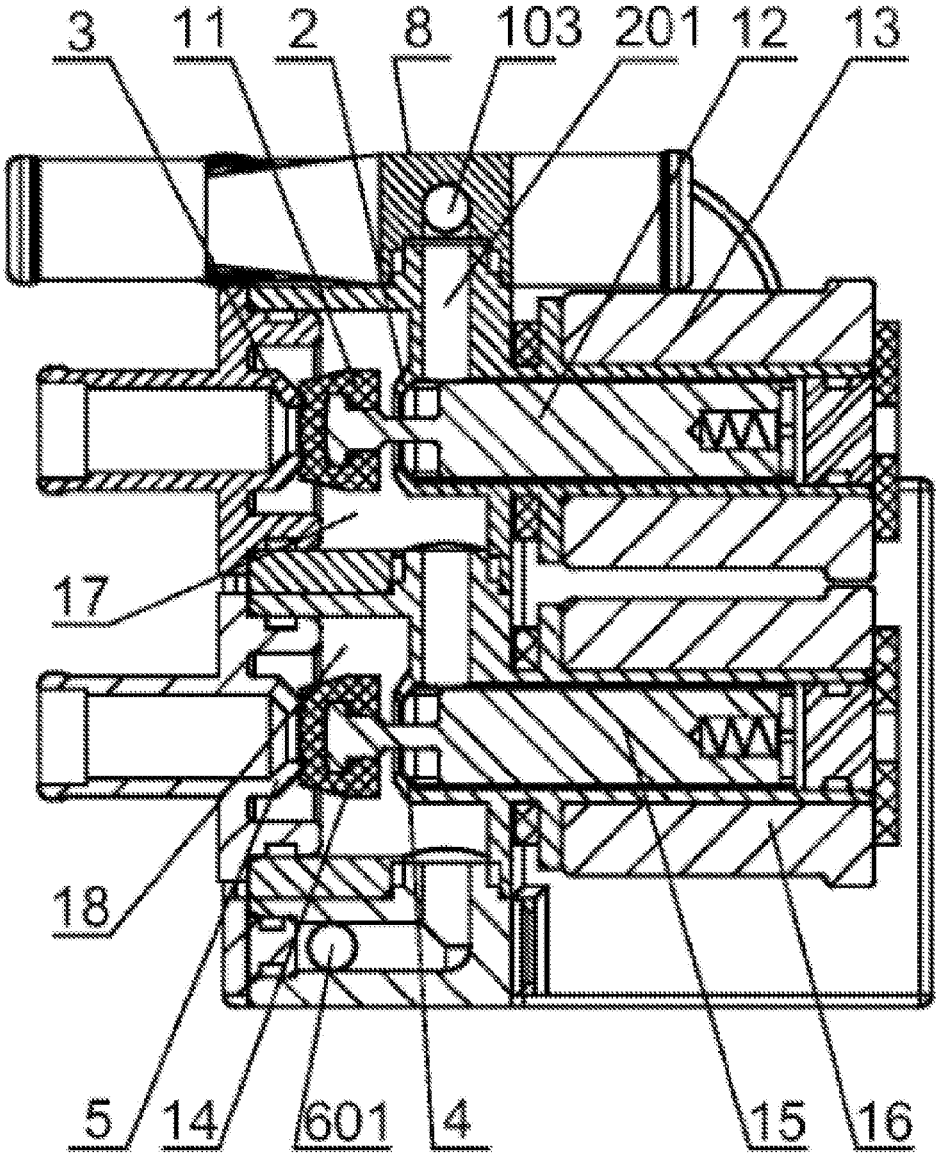
FIG. 4 is a sectional view of a structure of FIG. 3 in A-A direction.
Figure 5:
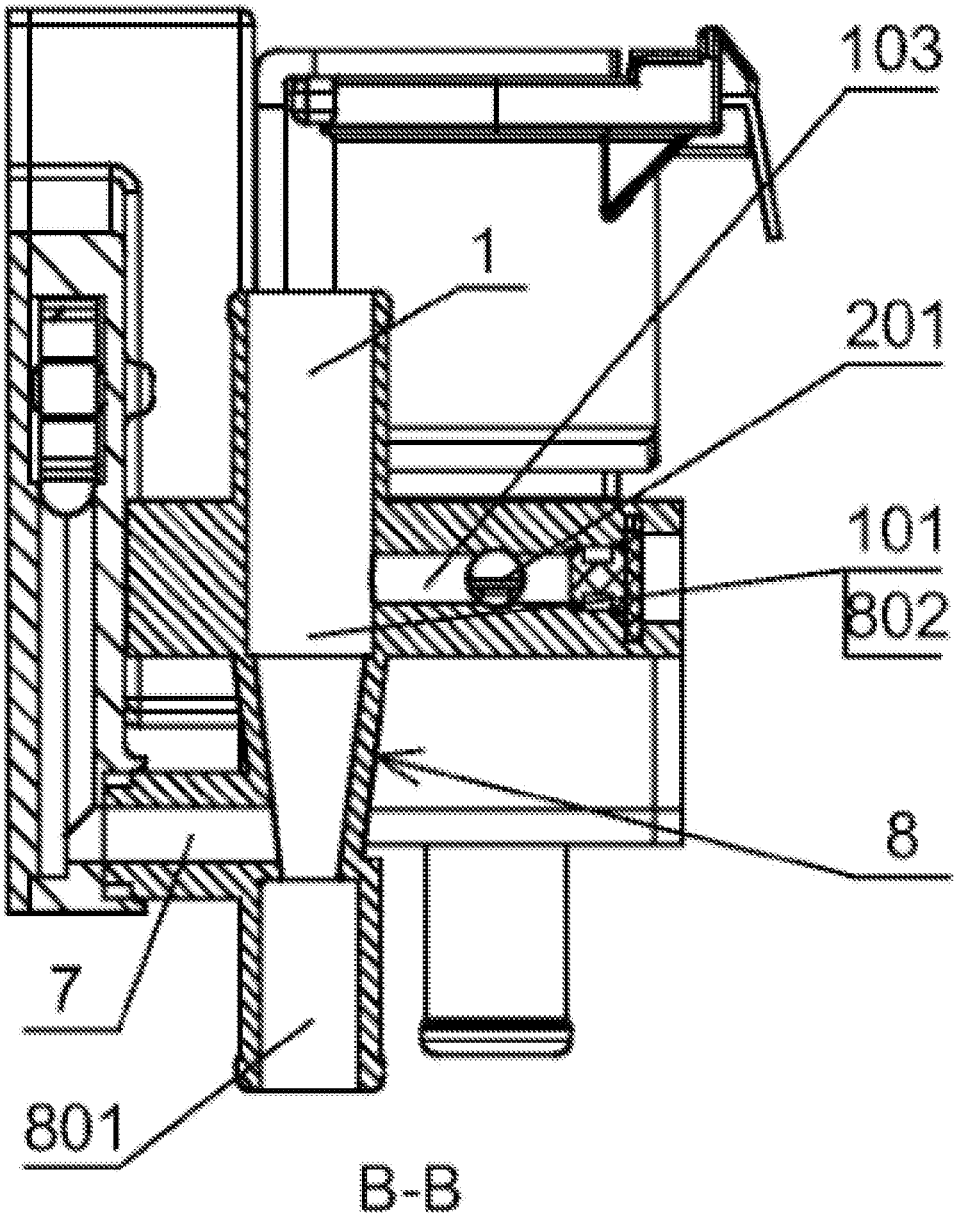
FIG. 5 is a sectional view of a structure of FIG. 3 in B-B direction.
Figure 6:
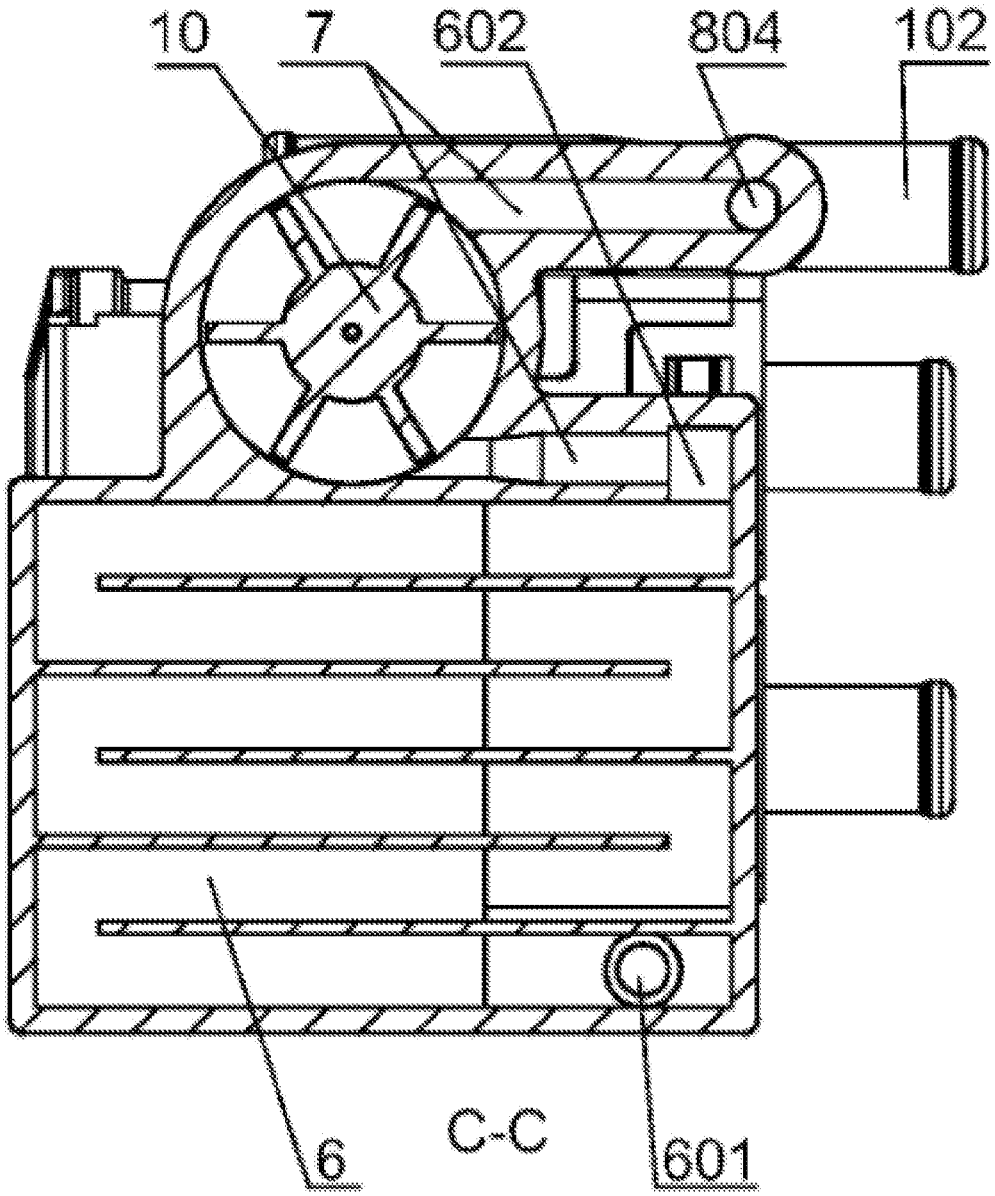
FIG. 6 is a sectional view of a structure of FIG. 3 in C-C direction.

Marks and corresponding pieces in the figures are provided as follow: 1: main channel, 101: inlet, 102: outlet, 103: bypass orifice of the main channel, 2: valve A, 201: inlet of valve A, 3: valve B, 4: valve C, 5: valve D, 6: liquid collecting cavity, 601: inlet, 602: outlet, 7: back-flow channel, 8: Venturi negative pressure generator, 801: inlet, 802: outlet, 803: extension segment (combination of the reducing segment-throat segment-expanding segment), 804: negative pressure opening, 10: flow sensor, 11: piston cap I, 12: piston I, 13: electromagnetic coil I, 14: piston II, 15: piston II, 16: electromagnetic coil II, 17: inner cavity I, 18: inner cavity II,

19: inner cavity II, 20 :valve E, 21: valve F, 22: piston cap III, 23: piston III, and 24: electromagnetic coil III.

DETAILED DESCRIPTION OF THE PREFERRED EMBODIMENTS

Embodiment 1

A detergent release controller has a main channel 1, one terminal of the main channel is an inlet 101 of a fluid, and the other terminal of the main channel is an outlet 102 capable of being connected with a water outlet of a washing barrel. The detergent disperse controller is provided with valve A 2, valve B 3, valve C 4, valve D 5, a liquid collecting cavity 6 and a Venturi negative pressure generator 8 are provided. An inlet of valve A is connected with a bypass of the main channel. An inlet of valve B is connected with a storage tank of detergent A. Outlets of valve A and valve B are connected with an inlet of valve C. An inlet of valve D is capable of being connected with a storage tank of detergent B. Outlets of valve C and valve D are connected with an inlet 601 of the liquid collecting cavity. An outlet 602 of the liquid collecting cavity is connected with a negative pressure opening 804 of the Venturi negative pressure generator via a back-flow channel 7. An outlet 802 of the Venturi negative pressure generator is connected with an inlet of the main channel; and an inlet 801 of the Venturi negative pressure generator is connected with a water source. The back-flow channel is provided with a flow sensor 10.

Embodiment 2

As shown in FIGS. 3, 4, 5 and 6, a detergent release controller in this Embodiment is provided with a pile-up valve. The pile-up valve is provided with a main channel 1, valve A 2, valve B 3, valve C 4, valve D 5, a liquid collecting cavity 6, a back-flow channel 7, and a Venturi negative pressure generator 8. One terminal of the main channel is an inlet 101 of a fluid, and the other terminal of the main channel is an outlet 1 capable of being connected with a water outlet of a washing barrel through a pipe. An inlet 201 of the valve A is connected with the main channel through a bypass orifice 103 of the main channel 1. Inlets of the valve B 3 is connected with a storage tank of detergent A. Outlets of the valve A and valve B run through an inner cavity I 17 and are connected with an inlet of valve C 4. An inlet of valve D 5 is capable of being connected with a storage tank of detergent B. Outlets of valve C and valve D run through an inner cavity II 18 which runs through an inlet 601 of the liquid collecting cavity 6. An outlet 602 of the liquid collecting cavity is connected with a negative pressure opening of the Venturi negative pressure generator via the back-flow channel 7. The back-flow channel is connected with a flow sensor 10. An outlet 802 of the Venturi negative pressure generator is connected with the inlet 101 of the main channel, and an inlet 801 of the Venturi negative pressure generator is connected with a water source.

The pile-up valve is provided with an electromagnetic valve component I and an electromagnetic component II; the electromagnetic valve component I has an electromagnetic coil I 13; an inner sleeve of the electromagnetic valve component I has a piston I 12; the front end of the piston I is connected with a piston cap I 11; the electromagnetic valve component II has an electromagnetic coil II 16; an inner sleeve of the electromagnetic coil II is provided with a piston II 15; the front end of the piston II is provided with a piston cap II 14.

Valve A and valve B correspond to the electromagnetic valve component I one-by-one. The outlet of valve A and the outlet of valve B run through an inner cavity 117 of the pile-up valve and are coaxially disposed at an interval in an opposite way in the inner cavity. The piston cap I of the electromagnetic valve component I is disposed within the interval between the outlet of valve A and the outlet of valve B. In normal state, the piston cap I closes the outlet of valve B and opens the outlet of valve A.

Valve C and valve D correspond to the electromagnetic valve component II one-by-one. The outlet of valve C and the outlet of valve D run through an inner cavity II 18 of the pile-up valve and are coaxially disposed at an interval in an opposite way in the inner cavity. The piston cap II of the electromagnetic valve component II is disposed within the interval between the outlet of valve C and the outlet of valve D. In normal state, the piston cap II closes the outlet of valve D and opens the outlet of valve C.

In this Embodiment, valve A 2 and valve B 3 are linked, and valve C and valve D are linked. When the electromagnetic coil I 13 is not electrified, the piston I 12 spring out by the effect of a spring at its rear end, and the piston cap I 11 closes the outlet of valve B 3 and opens the outlet of valve A 2. Likewise, when the electromagnetic coil II 16 is not electrified, the piston II 15 springs out by the effect of a spring at its rear end, and the piston cap II 14 closes the outlet of valve D 5 and opens the outlet of valve C 4. A small part of the water branch of the main channel 1 passes through the bypass orifice 103 of the main channel and the inlet 201 of valve A to enter the inner cavity I 17 and the inner cavity II 17, and then enters the liquid collecting cavity 6 via the inlet 601 of the liquid collecting cavity. The water in the liquid collecting cavity enters the back-flow channel through the outlet 602, then enters the main channel 1 through the flow sensor 10 and the negative pressure opening 804 of the Venturi negative pressure generator, and next is mixed with the water flow comes from the inlet 801 of the Venturi negative pressure generator to flush the liquid collecting cavity and the related flow path, thus preventing solidification of the detergent from affecting the use of the present disclosure.

To continue, when the electromagnetic coil is electrified, the piston I is sucked, and the piston cap I 11 closes the outlet of valve A 2 and opens the outlet of valve B 3, thus realizing release of the detergent A. When the electromagnetic field II is electrified, the detergent B is released.

Embodiment 3

Figure 7:
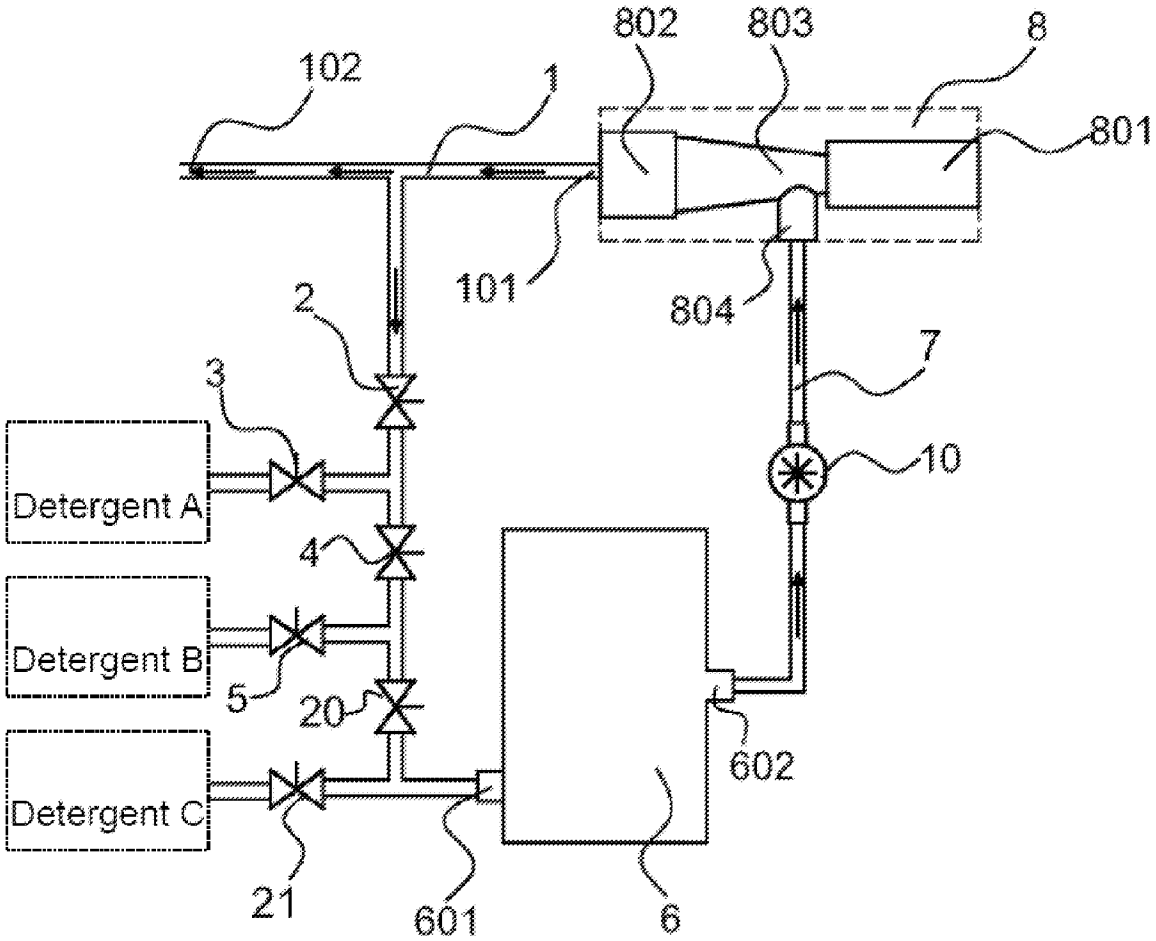
FIG. 7 is a schematic diagram illustrating a three-piece-connected structure of the present disclosure.
Figure 8:
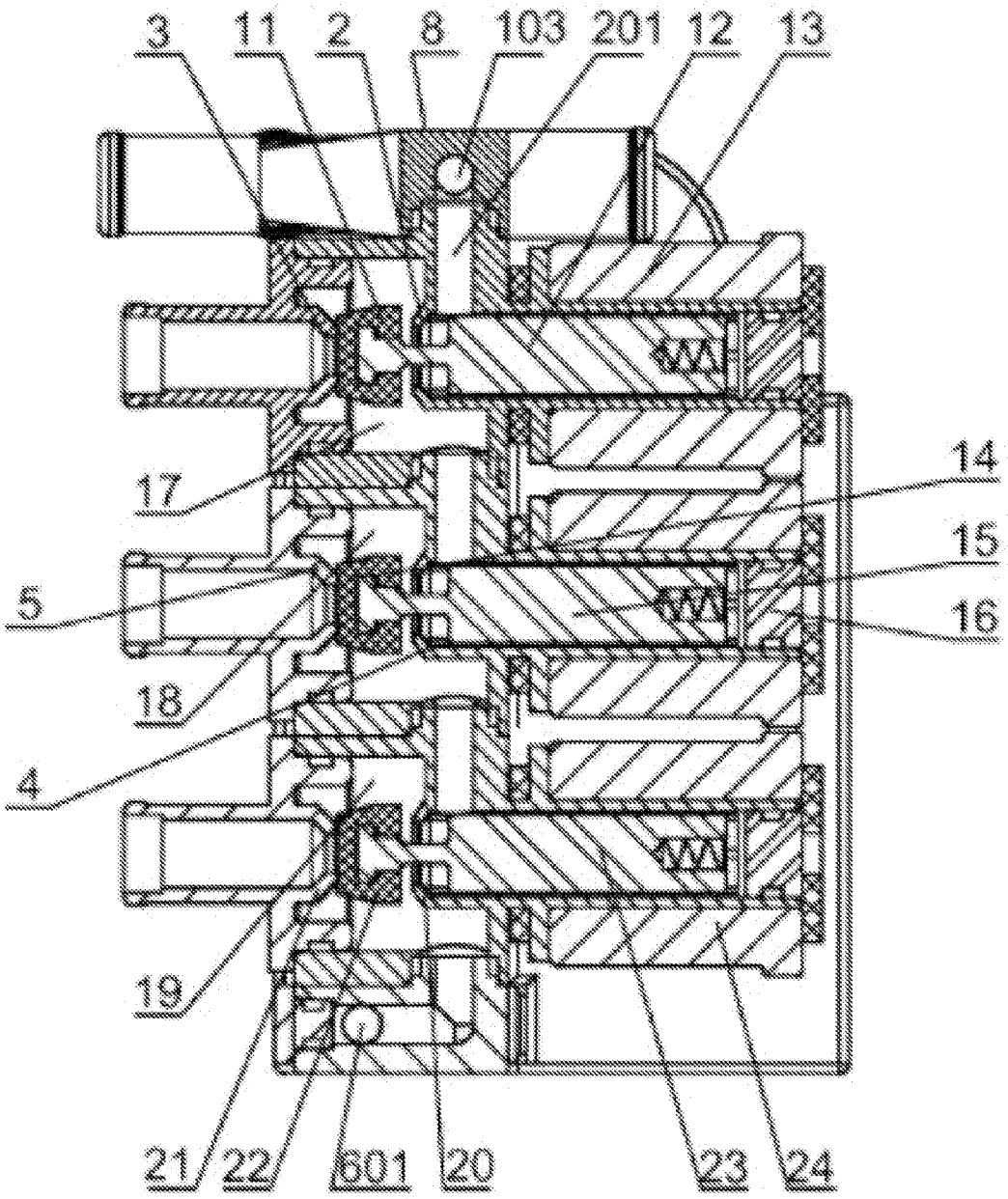
FIG. 8 is a schematic diagram illustrating a three-piece-connected structure of the present disclosure with a pile-up valve.

In this Embodiment, the detergent release controller, as shown in FIGS. 7 and 8, is added with valve E 20, valve F 21 and an electromagnetic valve component III including a piston cap III 22, a piston III 23 and an electromagnetic coil III 24. In this Embodiment, the outlets of valve C and valve D run through the inner cavity II 18 and are connected with the inlet of valve E 20; the inlet of valve F is capable of being connected with the storage tank of detergent C; the outlets of valve E and valve F run through the inner cavity III 19; the inner cavity III runs through the inlet 601 of the liquid collecting cavity 6; the inner cavity I, the inner cavity II and the inner cavity III run through one another.

Valve E 20 and valve F 21 correspond to the electromagnetic valve component III one-by-one. The outlet of valve E and the outlet of valve F run through an inner cavity III 19 of the pile-up valve and are coaxially disposed at an interval in an opposite way in the inner cavity III. The piston cap III of the electromagnetic valve component III is disposed within the interval between the outlet of valve E and the outlet of valve F. In normal state, the piston cap III closes the outlet of valve E and opens the outlet of valve E.

Other structures are similar to those of the Embodiment 2.

What is claimed is:

1. A detergent release device comprising:

a main channel comprising a first terminal and a second terminal, the first terminal comprising an inlet of a fluid, the second terminal comprising an outlet capable of connecting to a water outlet of a washing barrel;

a plurality of valves comprising valve A, valve B, valve C, and valve D, an inlet of valve A connected with a bypass of the main channel, an inlet of the valve B connected with a storage tank of detergent A, outlets of the valve A and the valve B connected with an inlet of the valve C, an inlet of the valve D capable of connecting to a storage tank of detergent B;

a liquid collecting cavity, outlets of the valve C and the valve D connected with an inlet of the liquid collecting cavity; and a Venturi negative pressure generator, an outlet of the liquid collecting cavity connected with a negative pressure opening of the Venturi negative pressure generator via a back-flow channel, an outlet of the Venturi negative pressure generator connected with an inlet of the main channel, an inlet of the Venturi negative pressure generator connected with a water source.

2. The detergent release device of claim 1, wherein the back-flow channel is connected with a flow sensor.

3. The detergent release device of claim 1, further comprising:

a pile-up valve, wherein:

the valve A, the valve B, the valve C, the valve D, the liquid collecting cavity and the back-flow channel are integrated in the pile-up valve;

the pile-up valve is provided with an electromagnetic valve component I and an electromagnetic component II;

the electromagnetic valve component I has an electromagnetic coil I;

an inner sleeve of the electromagnetic valve component I has a piston I;

a front end of the piston I is connected with a piston cap I;

the electromagnetic valve component II has an electromagnetic coil II;

an inner sleeve of the electromagnetic coil II is provided with a piston II;

a front end of the piston II is provided with a piston cap II;

the valve A and the valve B correspond to the electromagnetic valve component I one-by-one;

the outlet of the valve A and the outlet of the valve B run through an inner cavity I of the pile-up valve and are coaxially disposed at an interval in an opposite way in the inner cavity;

the piston cap I of the electromagnetic valve component I is disposed within the interval between the outlet of valve A and the outlet of valve B, the piston cap I capable of closing the outlet of the valve B and opening the outlet of the valve A;

the valve C and the valve D correspond to the electromagnetic valve component II one-by-one;

the outlet of valve C and the outlet of valve D run through an inner cavity II of the pile-up valve and are coaxially disposed at an interval in an opposite way in the inner cavity;

the piston cap II of the electromagnetic valve component II is disposed within the interval between the outlet of valve C and the outlet of valve D, the piston cap II capable of closing the outlet of valve D and opening the outlet of valve C; and the inner cavity II runs through the inlet of the liquid collecting cavity.

4. A detergent release device comprising:

a main channel, a terminal of the main channel comprising an inlet of a fluid, a second terminal of the main channel comprising an outlet capable of being connected with a water inlet of a washing barrel;

a plurality of valves comprising valve A, valve B, valve C, valve D, valve E, valve F, an inlet of valve A connected with a bypass of the main channel, an inlet of valve B capable of being connected with a storage tank of detergent A, outlets of the valve A and the valve B connected with an inlet of the valve C, an inlet of the valve D capable of being connected with a storage tank of detergent B, outlets of the valve C and the valve D connected with an inlet of the valve E, an inlet of the valve F connected with a storage tank of detergent C, outlets of the valve E and the valve F connected with an inlet of a liquid collecting cavity; and a Venturi negative pressure generator, an outlet of the liquid collecting cavity connected with a negative pressure opening of the Venturi negative pressure generator via a back-flow channel, an outlet of the Venturi negative pressure generator connected with an inlet of the main channel, an inlet of the Venturi negative pressure generator connected with a water source.

5. The detergent release device of claim 4, wherein the back-flow channel is connected with a flow sensor.

6. The detergent release device of claim 4, further comprising:

a pile-up valve, wherein:

the valve A, the valve B, the valve C, the valve D, the valve E, the valve F, the liquid collecting cavity and the back-flow channel are integrated in the pile-up valve;

the pile-up valve is provided with an electromagnetic valve component I, an electromagnetic valve component II and an electromagnetic component III;

the electromagnetic valve component I has an electromagnetic coil I;

an inner sleeve of the electromagnetic valve component I has a piston I;

a front end of the piston I is connected with a piston cap I;

the electromagnetic valve component II has an electromagnetic coil II;

an inner sleeve of the electromagnetic coil II is provided with a piston II;

a front end of the piston II is connected with a piston cap II;

the electromagnetic valve component III has an electromagnetic coil III;

an inner guide sleeve of the electromagnetic coil III is provided with a piston III;

a front end of the piston III is provided with a piston cap III;

the valve A and the valve B correspond to the electromagnetic valve component I one-by-one;

the outlet of valve the A and the outlet of the valve B run through an inner cavity I of the pile-up valve and are coaxially disposed at an interval in an opposite way in the inner cavity;

the piston cap I of the electromagnetic valve component I is disposed within the interval between the outlet of the valve A and the outlet of the valve B, the piston cap I capable of closing the outlet of valve B and opening the outlet of valve A;

the valve C and the valve D correspond to the electromagnetic valve component II one-by-one;

the outlet of the valve C and the outlet of the valve D run through an inner cavity II of the pile-up valve and are coaxially disposed at an interval in an opposite way in the inner cavity;

the piston cap II of the electromagnetic valve component II is disposed within the interval between the outlet of the valve C and the outlet of the valve D, the piston cap II capable of closing the outlet of valve D and opening the outlet of valve C;

the valve E and the valve F correspond to the electromagnetic valve component III one-by-one;

the outlet of the valve E and the outlet of the valve F run through an inner cavity III of the pile-up valve and are coaxially disposed at an interval in an opposite way in the inner cavity III;

the piston cap III of the electromagnetic valve component III is disposed within the interval between the outlet of the valve E and the outlet of the valve F, the piston cap III capable closing the outlet of the valve E and opening the outlet of the valve F; and the inner cavity III runs through the inlet of the liquid collecting cavity.

7. The detergent release device of claim 6, wherein the Venturi generative pressure generator and the main channel are combined in the pile-up valve.

* * * * *